US005203157A

United States Patent [19]

Stahlecker

[11] Patent Number: 5,203,157

[45] Date of Patent: Apr. 20, 1993

[54] SPINNING MACHINE FOR PNEUMATIC FALSE-TWIST SPINNING

[75] Inventor: Hans Stahlecker, Haldenstrasse 20, 7334 Süssen, Fed. Rep. of Germany

[73] Assignees: Hans Stahlecker; Fritz Stahlecker, both of Fed. Rep. of Germany

[21] Appl. No.: 719,013

[22] Filed: Jun. 21, 1991

[30] Foreign Application Priority Data

Jul. 19, 1990 [DE] Fed. Rep. of Germany ..... 4022969

[51] Int. Cl.[5] ..... D01H 5/28; D01H 7/46; B65H 54/02

[52] U.S. Cl. ..... 57/313; 57/328; 242/35.5 R

[58] Field of Search ..... 57/328, 333, 264, 81, 57/83, 86, 281, 90, 261, 270, 313, 22; 242/35.5 A, 35.5 R

[56] References Cited

U.S. PATENT DOCUMENTS

| | | | |
|---|---|---|---|
| 1,146,238 | 7/1915 | Cotter | 57/90 |
| 2,061,498 | 11/1936 | Bird | 57/90 X |
| 3,327,464 | 6/1967 | Halleux | 57/83 |
| 3,903.681 | 9/1975 | Bous | 57/90 X |
| 3,913,853 | 10/1975 | Raasch | 242/35.5 A X |
| 4,466,236 | 8/1984 | Lagemann | 57/86 X |
| 4,535,944 | 8/1985 | Nakahara et al. | 57/328 X |
| 4,601,434 | 7/1986 | Mori et al. | 242/35.5 A |
| 4,619,109 | 10/1986 | Suzuki et al. | 57/328 X |
| 4,669,260 | 6/1987 | Saviolo | 57/328 X |
| 4,676,061 | 6/1987 | Yamamoto | 57/90 X |
| 4,833,874 | 5/1989 | Stahlecker et al. | 57/261 |
| 4,845,936 | 7/1989 | Artzt et al. | 57/261 |
| 4,917,562 | 4/1990 | Colli et al. | 57/281 X |
| 4,967,547 | 11/1990 | Stahlecker | 57/328 |
| 4,998,407 | 3/1991 | Matsui et al. | 57/281 X |
| 5,044,148 | 9/1991 | Fujiwara | 57/261 X |

FOREIGN PATENT DOCUMENTS

| | | | |
|---|---|---|---|
| 3416387 | 11/1984 | Fed. Rep. of Germany . | |
| 2215743 | 9/1989 | United Kingdom | 57/90 |

OTHER PUBLICATIONS

Leaflet: Murata, 802 Murata-Jebspinner and No. 881 Murata Twin-Spinner (prior to Jun. 1991).

English Language brochure "PLYfil 1000 and PLYfil 2000". Sep. 1989.

German Language brochure "PLYFil1000 and PLYfil 2000 with Automation". Sep. 1989.

*Primary Examiner*—Daniel P. Stodola
*Assistant Examiner*—Michael R. Mansen
*Attorney, Agent, or Firm*—Evenson, McKeown, Edwards & Lenahan

[57] ABSTRACT

In the case of a spinning machine for the pneumatic false-twist spinning of staple fibers, it is provided that each spinning point is constructed as a double spinning point for subjecting two slivers to spinning which comprises devices for drafting which is common to both slivers, respective separate devices for pneumatic false-twisting and respective separate devices for winding the yarns onto intermediate packages, and that, in an automatic interconnection, a spooling machine is arranged which rewinds the yarns of the intermediate packages onto normal packages.

17 Claims, 7 Drawing Sheets

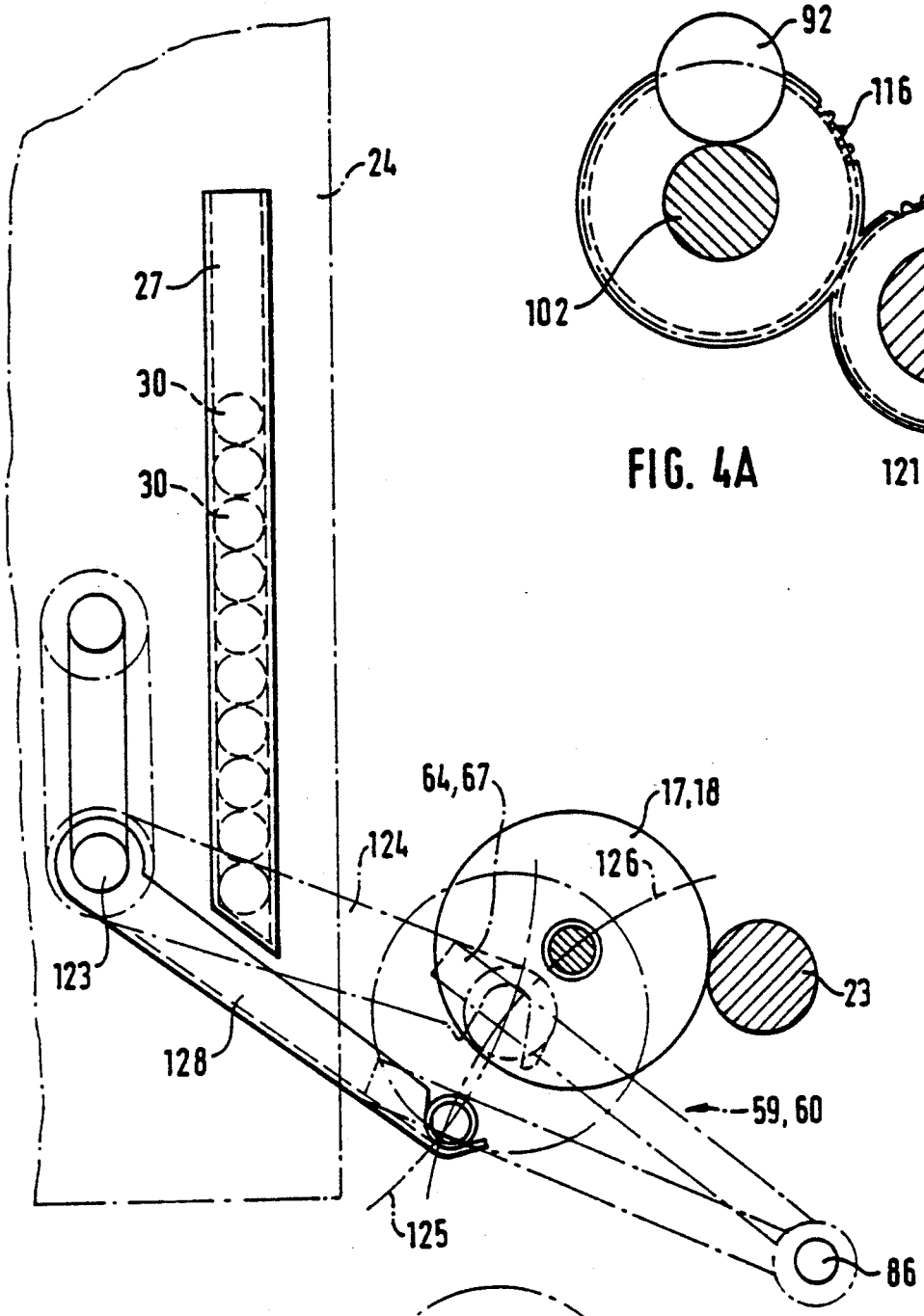
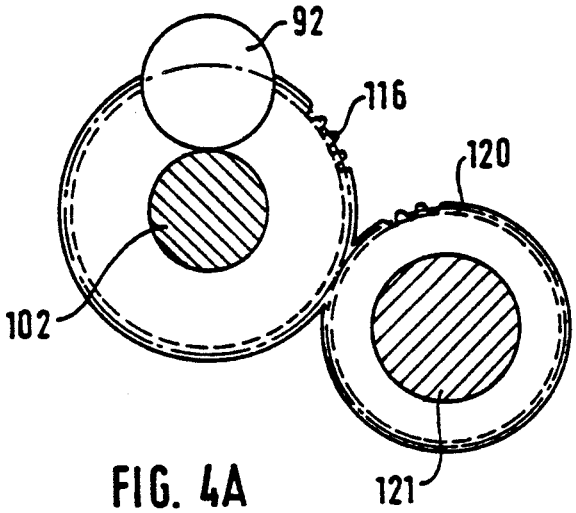
FIG. 4A
FIG. 5
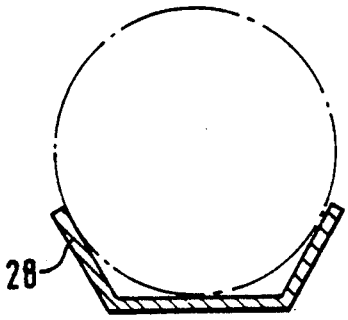

SPINNING MACHINE FOR PNEUMATIC FALSE-TWIST SPINNING

BACKGROUND AND SUMMARY OF THE INVENTION

The invention relates to a spinning machine for the pneumatic false-twist spinning of staple fiber yarn, having a plurality of spinning points or units which each comprise devices for the drafting of the fed slivers, devices for the pneumatic false-twisting of the drafted slivers, devices for the withdrawal of the spun yarns, and devices for winding the spun yarns onto spools.

In the case of a known air spinning machine, the No. 802 Murata Jet Spinner, a spool package is produced at every spinning point which already has a shape and size which is suitable for further processing. Each spinning point comprises a drafting unit through which the sliver travels which subsequently will be false-twisted pneumatically. The resulting spun yarn is withdrawn by a withdrawal device and is wound onto a cross-wound package. Each spinning point is equipped with a yarn cleaner which detects yarn defects and interrupts the spinning operation when an impermissible yarn defect occurs. During a subsequent piecing, the yarn defect is cleaned out, in which case the new connecting point is formed as a spliced connection.

A modification of the air spinning machine is also known, which is the No. 881 Murata Twin Spinner, in which two yarns are produced at each spinning point which are wound onto a spool package next to one another, that is, side-by-side. This spool package is used as a feeding package for a twisting. In this modified construction, two slivers travel side-by-side through each drafting unit and connecting false-twisting nozzles. Behind these false-twisting nozzles, the jointly withdrawn yarns are guided together and wound onto the spool. Also in the case of this construction, yarn cleaners are provided at each spinning point which, in a corresponding manner, monitor the double yarn with respect to yarn defects and, when an impermissible yarn defect occurs, interrupt the operation, clean out the yarn defect and replace it by a spliced connection.

Spinning machines are also known, such as the Süssen-Plyfil 1000 and the Süssen Plyfil 2000, in which each spinning point comprises two drafting units which are used for drafting a sliver. The two drafted slivers are subsequently guided through separate air nozzles and prestrengthened. The prestrengthened yarns are then guided together and are wound side-by-side onto a common cross-wound package. These cross-wound packages are used as feeding packages for a subsequent twisting on a twisting machine on which the packages are made with the finished yarn product and the yarn product that can be processed further.

It is an object of the invention to provide a spinning machine of the initially mentioned type which permits a low-cost manufacturing of the machine itself without having to accept limitations concerning the spinning-technological function.

This object is achieved in that each spinning point is constructed as a double spinning point for the spinning of two slivers, the double spinning point comprising common devices for the two slivers for the drafting, separate devices for the pneumatic false-twisting and separate devices for the winding-up of the yarns onto narrow intermediate spools, and in that a spooling machine is arranged in an automatic interconnection which rewinds the yarns of the intermediate spools onto normal spools.

The invention is first based on the recognition that the spool size represents a limitation in today's spinning machines. During the further processing, spools with a width of less than six inches are no longer accepted today. The width of these spools therefore significantly contributes to determining the overall length of the machine and therefore indirectly also the price of the machine. By giving up the large spool format, it is possible to much better utilize the machine itself because twice the amount of yarn can be spun virtually at each spinning point without excessively high expenditures. At close view, the rewinding which is required because of the giving-up of the spool format is no disadvantage but rather an advantage. On the one hand, the number of spooling points of the spooling machine to be arranged in the interconnection may be kept relatively low because of the significantly higher spooling speeds. The savings achieved at the spinning units are by far not used up by the price of the spooling machine. On the other hand, there is the advantage that the yarn cleaning may be carried out at the spooling points of the spooling machine. The number of required yarn cleaners and the resulting connected operations are therefore significantly lower. On the whole, an important price advantage is therefore achieved in comparison to the conventional spinning machines without having to accept disadvantages with respect to the spinning quality.

An interconnected system between a spooling machine and an air spinning machine is known (German Patent Document DE-A 34 16 387 and corresponding U.S. Pat. No. 4,601,4 ) in which the large-format spools produced on the respective spinning machine are to be rewound. An interconnected system of this type, in principle, is also suitable for the present invention because the significantly smaller intermediate spools may be processed automatically in the same manner.

Other objects, advantages and novel features of the present invention will become apparent from the following detailed description of the invention when considered in conjunction with the accompanying drawings.

BRIEF DESCRIPTION OF THE DRAWINGS

FIG. 4A is a lateral view of a detail of FIG. 4;

FIG. 5 is a partial lateral view of a drivable servicing apparatus with the devices for carrying out an exchange of intermediate spools constructed according to preferred embodiments of the present invention;

DETAILED DESCRIPTION OF THE DRAWINGS

Figure 1:
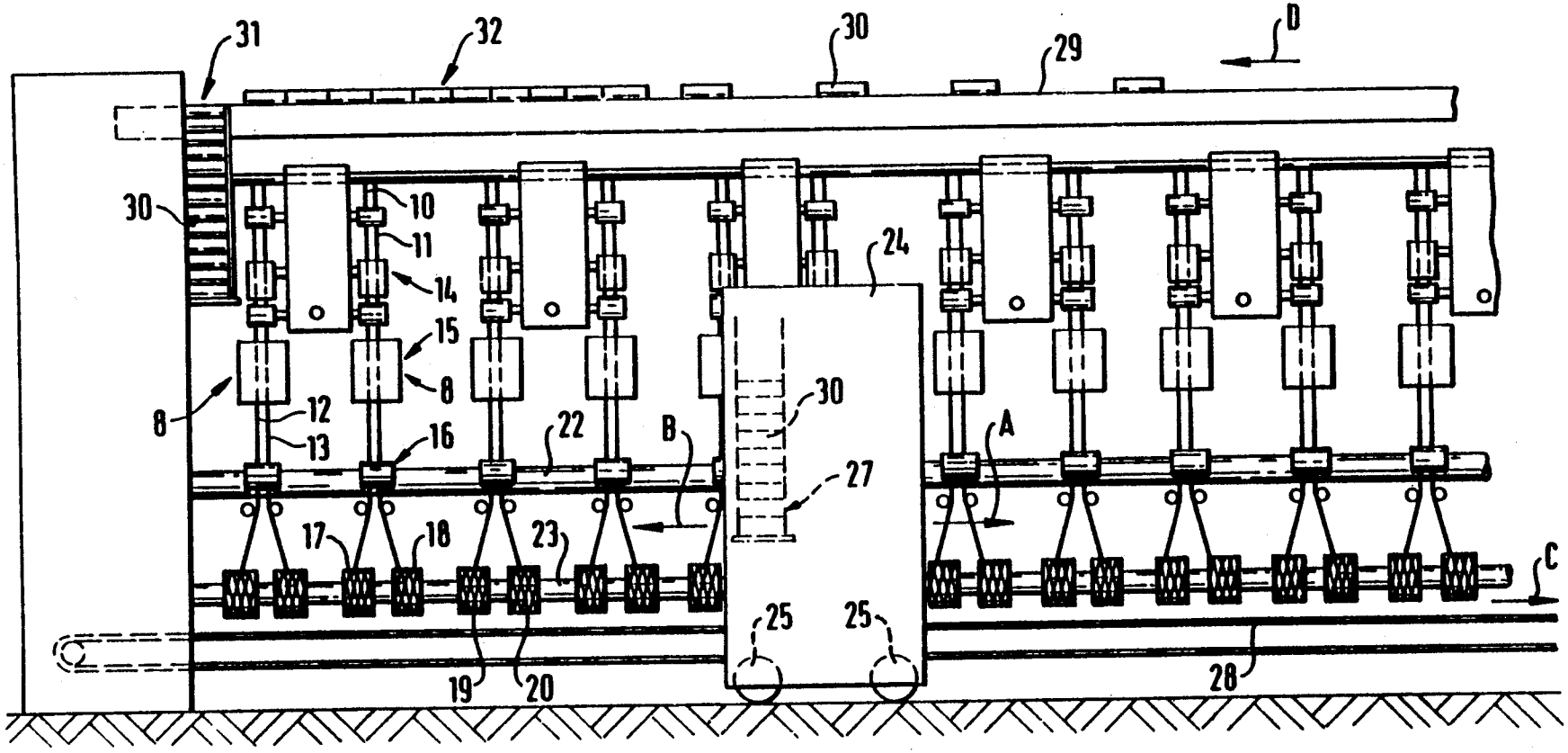
FIG. 1 is a schematic partial frontal view of a spinning machine constructed according to a preferred embodiment of the invention.

The spinning machine for pneumatic false-twist spinning, a so-called air spinning machine, illustrated in FIG. 1 has a plurality of spinning points arranged in a row on one side of the machine which are constructed as double spinning points 8. At each of these double spinning points 8, two slivers 10, 11 are subjected to spinning and are withdrawn from a feeding device which is not shown, specifically from spinning cans. In a common drafting unit 14, the two slivers 10, 11 are drafted to the desired yarn size. They then separately travel through their own pneumatic false-twisting devices 15 in which they are spun into air-spun yarns 12, 13 in a known manner. The yarns 12, 13 are withdrawn by means of a common withdrawal device 16 and are then each wound onto intermediate spools 17, 18 which have a width that is significantly smaller than that of the spools which normally have a width of six inches or more. The intermediate spools 17, 18 have, for example, only approximately half this width.

On the basis of this arrangement, in which two slivers 10, 11 are drafted and two yarns 12, 13 are spun in a double spinning point 8 which are wound onto intermediate spools 17, 18, it is possible to spin twice the number of yarns in a spinning machine which can be spun in a machine of the same size which produces spool packages of the normal size. As will be explained in detail in the following, only relatively few additional parts are required for creating double spinning points 8 which, on the one hand, do not increase the length of the spinning machine and which, on the other hand, do not very significantly increase the price in comparison to a conventional machine.

Figure 4:
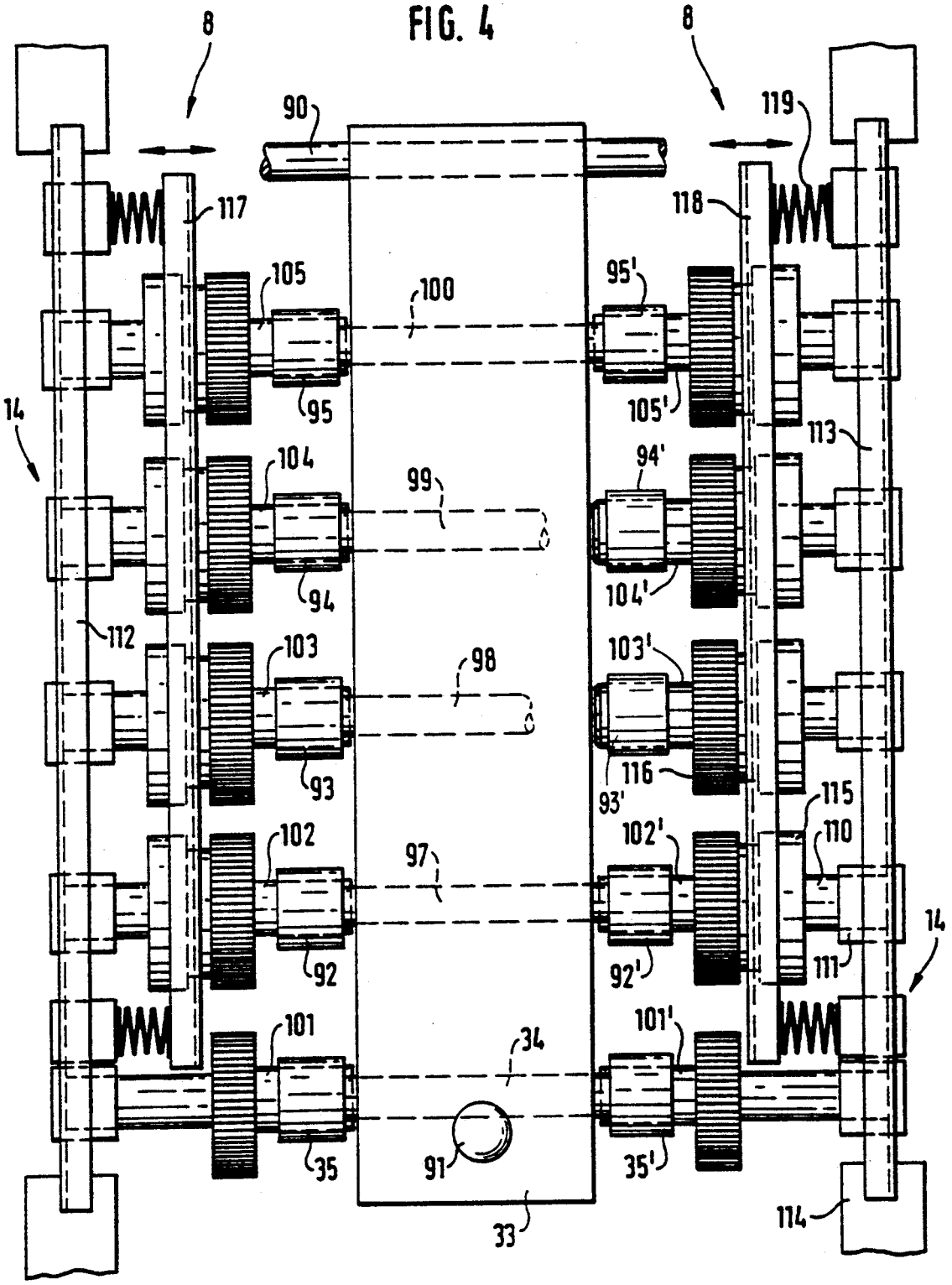
FIG. 4 is a partial view of the spinning machine according to FIG. 1 and 2 in the area of a drafting unit intended for two double spinning points.

The drafting units 14, which are illustrated in FIGS. 4 and 4A, in their basic structure, correspond to the drafting units described in the German Patent Application P 38 44 072.5 and corresponding to U.S. Pat. No. 4,991,263. One double spinning point 8 respectively has a common drafting unit 14 which is constructed as a so-called autonomous drafting unit. A common load carrier 33 is assigned to two adjacent double spinning points 8 respectively and can be swivelled about a carrying rod 90 extending in the longitudinal direction of the machine. The load carrier 33 receives shafts 34, 97, 98, 99, 100 on which pressure rollers 35, 35', 92, 92', 93, 93', 94, 94', 95, 95' are disposed in a freely rotatable manner and are assigned to one double spinning point 8 respectively. The load carrier 33 is equipped with a handle 91 and with a locking device which is not shown. The drafting units 14 of the two adjacent double spinning points 8 comprise bottom rollers 101, 101', 102, 102', 103, 103', 104, 104', 105, 105' which are constructed as stub shafts, which are arranged mirror-symmetrically with respect to the load carrier 33 and, by means of stud bolts 110, corresponding to the German Patent Application P 38 44 072.5 are overmounted in bearing receiving devices 111. The bearing receiving devices 111 are held in longitudinal members which extend in the longitudinal direction of the drafting units 14 and which, by means of transverse members which are not shown form a frame which is fastened to holders 114 of the machine frame. With the exception of the delivery rollers 101 which may continue to run during a yarn breakage without interfering with the subsequent piecing, all bottom rollers 102, 102', 103, 103', 104, 104', 105, 105' are equipped with disengageable couplings 115 which have a reference number only for the bottom roller 102'. The disengageable couplings 115, in their disengaged position, separate the bottom roller 102' from a gear wheel 116 which is in a permanent engagement with a gear wheel 120 which is non-rotatably arranged on a shaft 121 extending in the longitudinal direction of the machine. As a result of the disengaging of the couplings 115, which takes place by way of common disengaging rails 117, 118 against the effect of pressure springs 119, the drafting units 14 on each double spinning point 8 can therefore be stopped individually.

In addition, the drafting units 14 of each double spinning point 8 comprise apron guides which are arranged in the second drafting zone between top rollers 93 and 94; 93', 94' and bottom rollers 103, 104; 103', 104' and in the drafting zone between top rollers 35, 92; 35', 92' and bottom rollers 101, 102; 101', 102'. The drafting units 14 also comprise known sliver guides which are not shown and which keep apart the two slivers 10, 11 which travel through each of these drafting units 14 side-by-side at a double spinning point 8.

Figure 2:
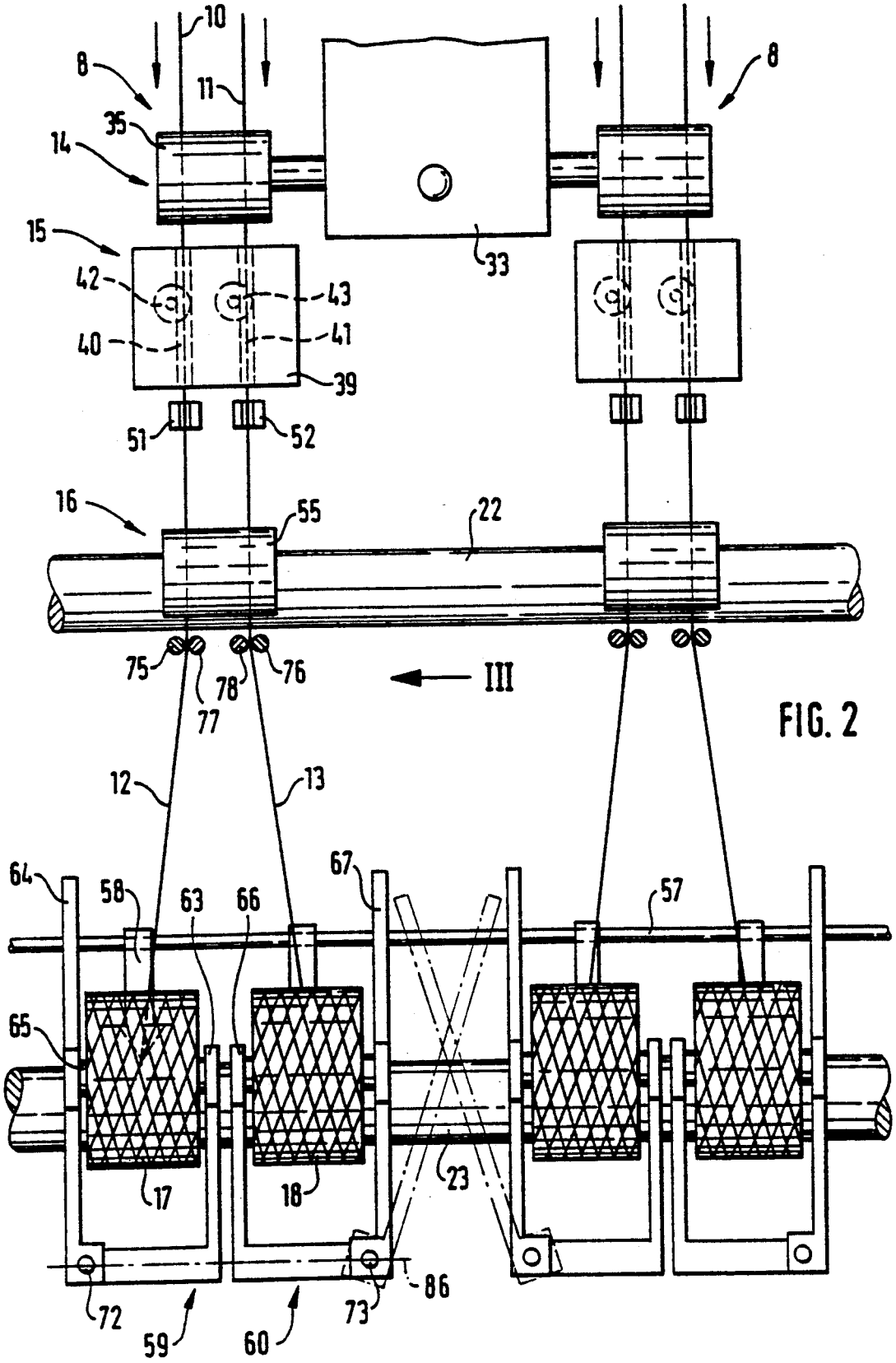
FIG. 2 is an enlarged cutout of the spinning machine of FIG. 1.
Figure 3:
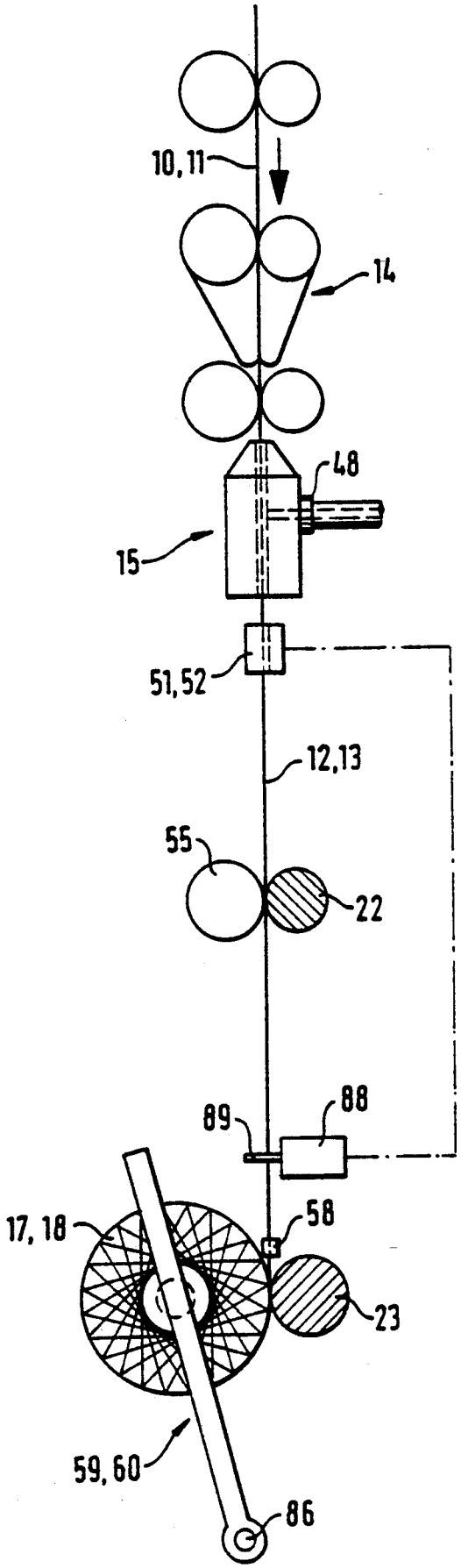
FIG. 3 is a schematic representation of a lateral view of a spinning point of the spinning machine according to FIG. 1 and 2.

As mentioned above, the drafting units 14 are followed by pneumatic false-twisting units 15 which are schematically shown in FIGS. 2 and 3 because their basic structure is known. In a common nozzle housing 39, two parallel yarn ducts 40, 41 of air nozzles are provided into which compressed air nozzles 42, 43 lead which are supplied by a compressed-air supply line 48. In this case, as known, one or several air nozzles may be arranged in the travelling direction of the yarn which form the yarn ducts 40, 41 and which are equipped with one or several twisting nozzles 42, 43.

At a relatively short distance, the yarn ducts 40, 41 are followed by yarn detectors 51, 52. By way of a control, which is not shown in detail, the yarn detectors 51, 52 are connected with the actuating elements for the disengaging rods 117, 118 by means of which the couplings 115 can be opened and therefore the corresponding drafting unit 14 can be stopped. When only one of the two yarns 12 or 13 breaks, the corresponding drafting unit 14 is stopped. In addition, the yarn detectors 51, 52, by way of the control, are also connected with two cutting devices 88 by which a blade 89 or the like can be brought into the travelling path of the yarns 12, 13 (FIG. 3). When one of the two yarns 12 or 13 breaks, the corresponding drafting unit 14 is stopped. In order to prevent in this case that the unbroken yarn component will run out in a pointed manner and will then be hard to find on the intermediate spool package 17, 18 during a piecing operation, the cutting devices 88 are actuated during each yarn breakage. The yarns 12, 13 are withdrawn from the false-twisting unit 15 by means of a withdrawal device 16. This withdrawal device 16 comprises a driven shaft 22, which extends through in the longitudinal direction of the machine and a pressure roller 55 which withdraws both yarns jointly. Naturally, it is also possible to assign to each of these yarns 12, 13 its own pressure roller which leads to no significant additional expenditures.

Behind the withdrawal device 16, the withdrawn yarns 12, 13 are still kept separate by yarn guides 75, 77; 76, 78. Then, they each travel to their pertaining intermediate spool package 17, 18 on which they are wound up into relatively narrow cross-wound packages. On a cross-winding rod 57 extending through in the longitudinal direction of the machine, cross-winding yarn guides 58 are arranged which are each assigned to one of the intermediate spool packages 17, 18 of each of the double spinning points 8. The intermediate spool packages 17, 18 rest with their circumference on a driven winding shaft 23 extending through in the longitudinal direction of the machine. They are arranged in spool frames 59, 60 which can be swivelled about a shaft 86 extending in parallel to the winding shaft 23. By means of devices, which are not shown, the spool frames 59, 60 are pressed against the winding shaft 23 with a given force.

The two spool frames 59, 60 of each double spinning point 8, which are assigned to the intermediate spool packages 17, 18, are constructed and arranged mirror-invertedly with respect to one another. On their sides which face one another, they have an arm 63, 66 which is rigidly mounted on the spool frames 59, 60. The arms 64, 67 which face away from one another, on the other hand, are mounted on the spool frames 59, 60 so that they can be swivelled away against the force of a spring about shafts 72, 73 extending transversely with respect to the swivel shaft 86. Between the spool arms 63, 64; 66, 67, the tubes 65 of the intermediate spools 17, 18 are held in a known manner by means of spool plates.

As shown in FIG. 2, a larger distance is maintained between the spool frames 59, 60 of two adjacent double spinning points 8 than between the spool frames 59, 60 of one double spinning point 8. As a result, it is possible to laterally swivel away the respective arms 64, 67 of the spool frame 59, 60 disposed on the outside in order to remove the intermediate spools 17, 18 from the respective spool frames 59, 60 or in order to insert empty tubes 65. As shown particularly well in FIG. 2, the spool frames 59, 60 of a double spinning point 8 take up only as much space as so far had been required for a spool frame of a normal-sized single spool package.

Between the withdrawal device and the cross-winding yarn guides 58, known compensating devices, which are not shown, are arranged which provide that a compensation of the yarn lengths takes place during the winding of the intermediate spool packages 17, 18 into cross-wound packages.

The above demonstrates that the additional expenditures for providing double spinning points 8 are relatively low. However, intermediate spool packages 17, 18 are produced in this case whose size corresponds approximately to only half of today's normal spool package format required for further processing. In order to compensate for this initially existing disadvantage, a spooling machine is interconnected as will be explained in detail by means of FIG. 7. By means of this spooling machine, which requires only relatively few spooling points, the packages are then wound in the normal format which is required in practice. In this case, a yarn cleaning takes place at the same time in a known manner so that the mounting of yarn cleaners in the area of the individual double spinning points 8 is not necessary so that here also the expenditures are reduced. Although the additional spooling machine requires increased expenditures, the expenditures required for this purpose are much lower than the savings which are obtained by providing double spinning points 8. In addition, the number of required spooling points is relatively low because of the very high spooling speeds.

Figure 6:
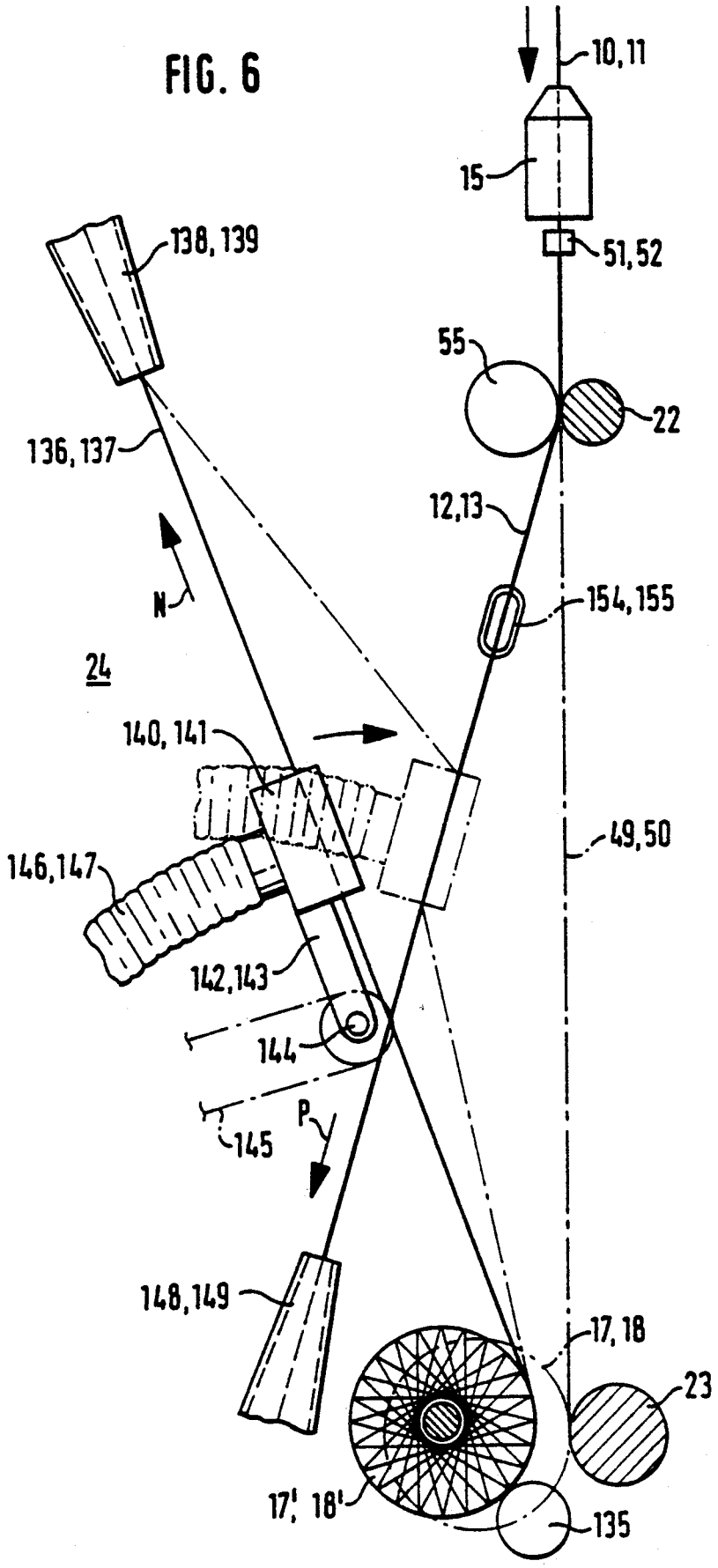
FIG. 6 is a lateral view of a servicing apparatus with the elements required for a piecing operation constructed according to a preferred embodiment of the present invention.

When a yarn breakage occurs at one of the double spinning points 8, a yarn breakage of the other yarn is necessarily caused so that then a piecing operation for both yarns 12, 13 must be carried out at the double spinning point 8. The principle of this piecing is explained in detail by means of FIG. 6. The piecing operation as such is carried out in a manner which is known in principle from the German Patent Document DE-A 38 17 221. The significant difference is only that all elements exist as twin elements because a piecing is carried out simultaneously on two yarns. The servicing apparatus 24 illustrated schematically in FIG. 1 which, by means of an undercarriage 25, patrols along the spinning machine in the direction of the arrows (A and B) will then be applied to the corresponding double spinning point when a yarn breakage is reported. The intermediate spool packages 17, 18 are swivelled away from the winding shaft 23 into the position 17', 18' indicated by drawnout lines. An auxiliary winding roller 135 of the servicing apparatus 24 is applied to the intermediate spool packages and can be driven in both rotating directions. Suction grippers 138, 139 are applied to the intermediate spool packages 17' 18 which take up the yarn ends from the intermediate spool packages 17', 18' while the auxiliary winding shaft 135 drives the intermediate spool packages 17' 18' in the wind-off direction. Then the suction grippers 138, 139, which may possibly be constructed as a twin suction device, move back in the direction of the arrow (N) into the servicing apparatus 24 while taking along the yarn ends 136, 137. In this case, the two yarn ends 136, 137 are placed in the splicing chambers of two adjacent splicing arrangements 140, 141. These splicing arrangements 140, 141 are constructed as known pneumatic splicing arrangements which are provided with yarn clamps, cutting devices and actuating elements, or the like and to which compressed air can be fed by way of lines 146, 147. Furthermore, the drafting unit 14 of the double spinning point 8 is switched on again so that the slivers 10, 11 travel into the false-twisting device 15. At the outlet of the false-twisting device 15, these slivers are taken up by means of suction grippers 148, 149 which place the two yarns 12, 13 in the withdrawal device 16 and which then move back into the servicing apparatus 24. Pneumatic storage arrangements 154, 155 are applied to the two travelling yarns 12, 13. The splicing arrangements 140, 141 are arranged on two levers 142, 143 or on a common lever which can be swivelled by means of a toothed belt drive 145 about a shaft 144 into the dash-dotted position in which the yarns 12, 13 are also inserted into the splicing chambers of the two splicing arrangements 140, 141. The yarns 12, 13, which continue to be produced during the splicing operation, are taken up by the storage arrangements 154, 155. After the conclusion of the splicing, the spliced yarns 12, 13 are released by the splicing arrangements 140, 141 after which the splicing arrangements 140, 141 move back into the servicing apparatus 24. The auxiliary winding roller 135 will then be driven at an increased speed in the wind-up direction so that the storage arrangements 154, 155 are emptied out. After the emptying, the auxiliary winding roller 132 is reduced to the operating speed after which the intermediate spools 17', 18' are transferred to the winding shaft 23 in the operating position indicated by an interrupted line so that the yarn travel of the two yarns 12, 13 is resumed which is indicated by an interrupted line.

The servicing apparatus 24 is also equipped with devices for carrying out the exchange of spool packages for the intermediate spool packages 17, 18, these devices being schematically shown in FIG. 5. This spool package exchange is carried out in one operation for both intermediate spool packages 17, 18 of a double spinning point 8. It may therefore happen that the elements described in the following may exist twice in the servicing apparatus 24, or that the servicing apparatus 24 is successively applied to the two intermediate spool packages 17, 18 and carries out the spool package exchange for both successively.

When the intermediate packages 17, 18 have reached the desired degree of fullness, this is determined by a known filling degree detector which initiates by way of a control that the two spool frames 59, 60 are swivelled in such a manner that the intermediate packages 17, 18 are lifted off the winding shaft 23 and take up the position illustrated by a dash-dotted line in FIG. 5. A swivel arm 124 of the servicing apparatus 24 will then be applied to the spool frames 59, 60 and brings the spool frames 59, 60 into a defined position in which the swivel radii 125 and 126 of the swivel arm 124 and of the package receiving devices of the spool frames 59, 60 intersect with one another. In this position, another lever of the servicing apparatus 24, which is not shown, is applied to the arms 64, 67 of the spool frames 59, 60 which can be swivelled away so that the full packages can be removed and can be placed on a groove-shaped conveyor belt 28.

Another groove-shaped arm 128 can be swivelled about the swivel shaft 123 of the swivel arm 124 and is used for receiving empty spool tubes 30 from a magazine 27 of the servicing apparatus 24 disposed above it. The magazine 27 is equipped with a separating device, which is not shown, and which delivers one spool tube 30 respectively to the swivel arm 128 on which this spool tube 30 will then roll to the end of the swivel arm 128. The spool tube 30 will then be disposed on the swivel radius 125 so that, by means of the swivelling of the swivel arm 128, it can be brought into the area of the spool plates of the spool frames 59, 60 and can be taken over by them. Then the spool frames 59, 60 are swivelled back into their operating position in which the spool tube 30 rests against the winding shaft 23.

Then, the servicing apparatus 24 can take up the newly spun yarns 12, 13 by means of the suction grippers 148, 149 in the manner described above by means of FIG. 6 and can place them against the empty spool tubes 30 inserted in the spool frames 59, 60.

As mentioned several times, the spinning machine is arranged in an automatic interconnection with a spooling machine having a suitable number of spooling points 159, 160, 161. This spooling machine comprises a conveyor belt 157 arranged as an extension of the conveyor belt 28. Conveyor belt 157 moves into the same direction (direction of arrows C and R) and takes over the intermediate spool packages 17, 18. By way of switches 162, 163, the intermediate spool packages 17, 18 are guided to the individual spooling points 160, 161 in which the wound-up yarns 12, 13 are wound off them and are rewound on large spools having a normal format. The empty spool tubes 30 leave the spooling points 159, 160, 161 on the opposite side and, by means of a conveyor belt 166 are guided back to the spinning machine in the direction of the arrow (S). There, in a manner not shown in detail, they are placed on a conveying device 29 which moves in the longitudinal direction of the machine and which forms a so-called tube rod from the empty spool tubes 30 which, at a given point of the machine, move into a tube magazine 31 fixed to the machine. If necessary, the servicing apparatus 24 can then be applied to this tube magazine 31 in order to replenish its supply of empty spool tubes 30.

Figure 7:
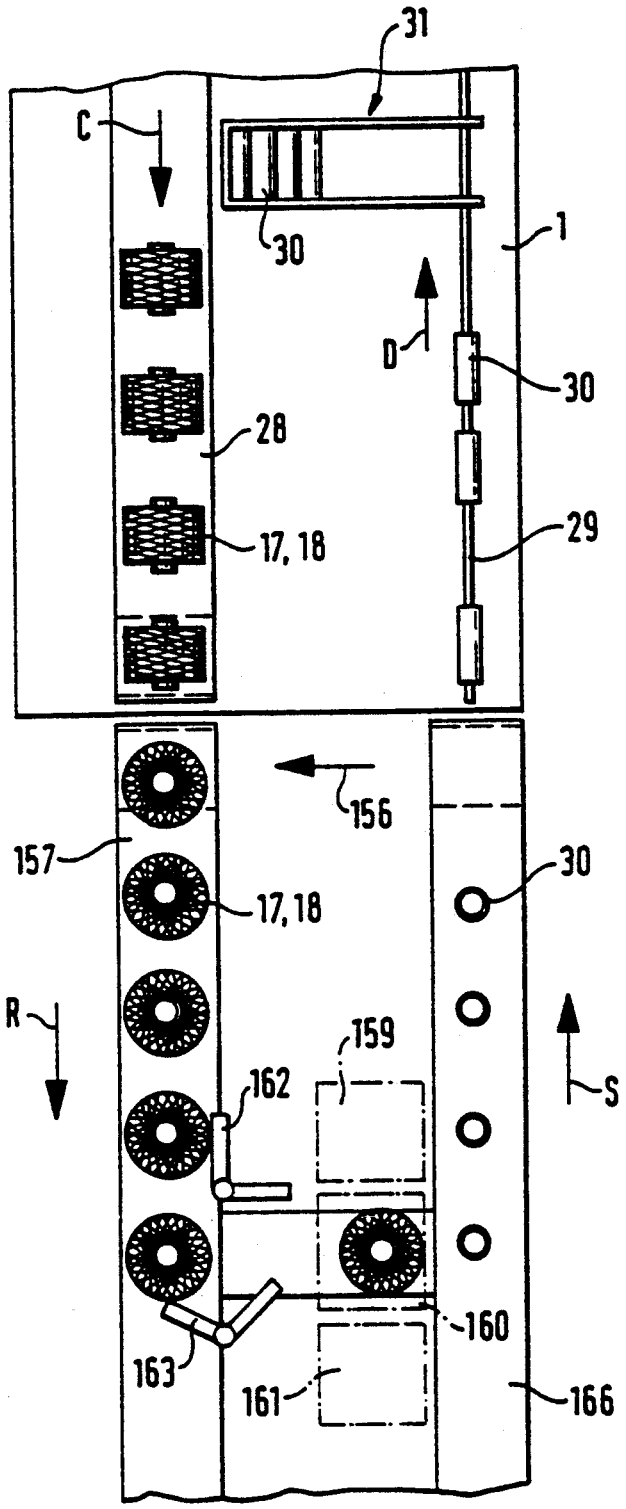
FIG. 7 is a top view of the area of the spinning machine with the spooling machine arranged in the automatic interconnection.

As shown in FIG. 7, the intermediate packages 17, 18, when entering into the spooling machine, are rotated such that their spool tubes are aligned vertically. This is expediently carried out by means of a device which fits the intermediate packages 17, 18 onto plates provided with spikes, as known, for example, from the German Patent Document DE-C 36 03 760. On these plates, the intermediate packages 17, 18 will then travel through the spooling points 159, 160, 161. On these plates, the empty spool tubes 30 will then also be removed which will then be withdrawn at the spinning machine and transferred to the conveying device 29. In the direction of the arrow 156, the then empty plates will be returned to the receiving point at which they are provided with intermediate packages 17, 18.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A spinning textile machine system including a plurality of spinning units, each of said spinning units comprising drafting apparatus for drafting fed slivers, pneumatic false-twisting apparatus for false twisting the drafted slivers, withdrawal apparatus for withdrawing the false-twisted yarn, and winding apparatus for winding the yarn onto spool packages, wherein each spinning unit is constructed as a double spinning unit for subjecting two slivers to spinning which comprises drafting apparatus common to both slivers, respective separate pneumatic false-twisting apparatus, and respective separate winding apparatus for winding the yarns onto a pair of narrow intermediate spool packages arranged on a common winding axis, said drafting apparatus common to both slivers including a single pressure roller engaged with both slivers during operation, and a spooling machine arranged in an automatic interconnection with the spinning units which rewinds the yarns of the intermediate packages to normal-sized spool packages of approximately twice the axial length of the intermediate packages.

2. A machine system according to claim 1, wherein each double spinning unit is equipped with two yarn detectors which art each assigned to one of the two yarns or slivers and stop the double spinning unit when there is a disturbance.

3. A machine system according to claim 2, wherein each double spinning unit is equipped with devices for cutting the travelling yarn which are each assigned to one yarn and which are controlled by the yarn detectors of the respective other yarn.

4. A machine system according to claim 3, wherein the drafting apparatus for each double spinning unit comprises a drafting unit having bottom rollers which can be separated from a drive in the case of a yarn breakage.

5. A machine system according to claim 3, comprising a movable servicing apparatus which can be applied to the respective double spinning units and which is equipped with devices for simultaneously piecing both yarns of a double spinning unit.

6. A machine system according to claim 3, comprising a movable servicing apparatus which can be applied to the respective double spinning units and which comprises devices for exchanging two intermediate packages of a double spinning unit.

7. A machine system according to claim 2, wherein the drafting apparatus for each double spinning unit comprises a drafting unit having bottom rollers which can be separated from a drive in the case of a yarn breakage.

8. A machine system according to claim 2, comprising a movable servicing apparatus which can be applied to the respective double spinning units and which is equipped with devices for simultaneously piecing both yarns of a double spinning unit.

9. A machine system according to claim 2, comprising a movable servicing apparatus which can be applied to the respective double spinning units and which comprises devices for exchanging two intermediate packages of a double spinning unit.

10. A machine system according to claim 2, wherein each double spinning point has two spool frames which are arranged closely next to one another in the longitudinal direction of the machine and which, on the sides facing one another, each comprise a rigid arm and, on the sides facing away from one another, comprise an arm which can be moved away axially with respect to the intermediate package.

11. A machine system according to claim 1, wherein the drafting apparatus for each double spinning unit comprises a drafting unit having bottom rollers which can be separated from a drive in the case of a yarn breakage.

12. A machine system according to claim 1, comprising a movable servicing apparatus which can be applied to the respective double spinning units and which is equipped with devices for simultaneously piecing both yarns of a double spinning unit.

13. A machine system according to claim 12, wherein said movable servicing apparatus can be applied to the respective double spinning units and comprises devices for exchanging two intermediate packages of a double spinning unit.

14. A machine system according to claim 12, wherein each double spinning point has two spool frames which are arranged closely next to one another in the longitudinal direction of the machine and which, on the sides facing one another, each comprise a rigid arm and, on the sides facing away from one another, comprise an arm which can be moved away axially with respect to the intermediate package.

15. A machine system according to claim 1, comprising a movable servicing apparatus which can be applied to the respective double spinning units and which comprises devices for exchanging two intermediate packages of a double spinning unit.

16. A machine system according to claim 15, wherein each double spinning point has two spool frames which are arranged closely next to one another in the longitudinal direction of the machine and which, on the sides facing one another, each comprise a rigid arm and, on the sides facing away from one another, comprise an arm which can be moved away axially with respect to the intermediate package.

17. A machine system according to claim 1, wherein each double spinning point has two spool frames which are arranged closely next to one another in the longitudinal direction of the machine and which, on the sides facing one another, each comprise a rigid arm and, on the sides facing away from one another, comprise an arm which can be moved away axially with respect to the intermediate package.

* * * * *